US007681562B2

(12) United States Patent
Boerjes

(10) Patent No.: US 7,681,562 B2
(45) Date of Patent: Mar. 23, 2010

(54) MULTIPLE PRIMARY COIL IGNITION SYSTEM AND METHOD

(75) Inventor: Herbert Boerjes, El Paso, TX (US)

(73) Assignee: Autotronic Controls Corporation, El Paso, TX (US)

( * ) Notice: Subject to any disclaimer, the term of this patent is extended or adjusted under 35 U.S.C. 154(b) by 100 days.

(21) Appl. No.: 12/023,463

(22) Filed: Jan. 31, 2008

(65) Prior Publication Data

US 2009/0194083 A1 Aug. 6, 2009

(51) Int. Cl.
*F02P 3/04* (2006.01)

(52) U.S. Cl. ..... 123/622; 123/595; 123/621; 123/644

(58) Field of Classification Search ..... 123/595, 123/621, 622, 644
See application file for complete search history.

(56) References Cited

U.S. PATENT DOCUMENTS 3,403,666 A 10/1968 Soehner et al.
3,476,098 A 11/1969 Cook
3,906,919 A 9/1975 Asik
3,910,247 A * 10/1975 Hartig ..... 123/634
3,972,315 A 8/1976 Munden
4,114,581 A 9/1978 Wurst
4,117,818 A 10/1978 Bodig et al.
4,140,946 A 2/1979 Gerry
4,208,992 A 6/1980 Polo
4,245,594 A * 1/1981 Morino et al. ..... 123/606
4,345,575 A 8/1982 Jorgensen
4,378,779 A * 4/1983 Hachiga et al. ..... 123/644
4,448,182 A 5/1984 Aoyama et al.
4,462,380 A 7/1984 Asik
4,478,201 A 10/1984 Asik
4,562,823 A 1/1986 Moritugu et al.
4,674,467 A 6/1987 Tokura et al.
4,702,221 A 10/1987 Tokura
4,770,152 A 9/1988 Mogi
4,915,087 A 4/1990 Boyer
5,197,449 A * 3/1993 Okamoto et al. ..... 123/622
5,211,152 A 5/1993 Alexandrov
5,425,348 A * 6/1995 Bracken ..... 123/643
5,806,504 A 9/1998 French
5,886,476 A 3/1999 Skinner et al.
6,213,108 B1 * 4/2001 Boyer et al. ..... 123/595
6,328,025 B1 12/2001 Marrs
6,352,069 B1 3/2002 Kraus
6,679,237 B1 1/2004 Skinner et al.
2005/0000502 A1 1/2005 Waters et al.

FOREIGN PATENT DOCUMENTS

JP 60187769 9/1985

* cited by examiner

*Primary Examiner*—Erick Solis
(74) *Attorney, Agent, or Firm*—Fitch, Even, Tabin & Flannery

(57) ABSTRACT

A first current is supplied to a first primary winding of an ignition coil and a second current is supplied to a second primary winding of the ignition coil. A voltage is generated across a secondary winding of the ignition coil and an ignition spark current is generated at a spark plug coupled to the secondary winding. The ignition spark current is based upon the generated voltage and the sum of the first current and the second current.

18 Claims, 8 Drawing Sheets

MULTIPLE PRIMARY COIL IGNITION SYSTEM AND METHOD

FIELD OF THE INVENTION

The field of the invention relates to ignition systems and, more specifically, to spark generation in these ignition systems.

BACKGROUND

Vehicular ignition systems typically operate when electrical current flows through a primary winding of an ignition coil and this current flow induces energy to be stored in a magnetic field associated with the coil. The inductance of the coil, the amount of supply current applied to the coil, and the dwell time of the coil (i.e., the time set aside to build the current in the primary winding of the coil) are some factors that determine the amount of energy that can be stored in the magnetic field of the coil.

The stored energy of the coil is released when the primary winding current is suddenly turned off and the released energy flows from the magnetic field as a secondary current in a secondary winding of the ignition coil. Due to the high turns ratio typically used in coils and the rapid collapse of the magnetic field in the coil, a spark is generated across a spark plug that is attached to the secondary winding of the coil.

Different types of coil configurations have been used in previous vehicular ignition systems. To take one example, "pencil" coils are a special type of coil that have relatively long and narrow dimensions and have been used, for instance, in motorcycle ignition systems. In pencil coil arrangements, electronic coil drivers are typically used to drive the coils and a separate coil (and driver) are used to drive each cylinder of the engine. The coil drivers are themselves typically controlled by an electronic control unit (ECU), which controls the current dwell time for each coil.

In many demanding applications (e.g., drag racing), it is often desirable to retrofit the system to increase the energy in the system to thereby provide a stronger spark than is normally provided. In attempting to achieve this result, some users replaced their older coils with newer coils having lower inductances thereby increasing the current in the coil and, consequently, the amount of energy that could be stored in the magnetic field associated with the coil. However, these approaches required that existing coil drivers and existing ECUs be able to handle the larger currents associated with the newer coils. Unfortunately, existing coil drivers and ECUs often were damaged or destroyed by these increased currents making it impractical or impossible to increase spark energy in existing systems to the levels desired.

Because of these problems, it was difficult or impossible to retrofit existing systems to provide for increased spark energy or other enhanced spark characteristics while at the same time protecting and preserving existing system components. This resulted in user frustration with these previous systems and the general inability to achieve the increased performance levels desired by users.

SUMMARY

Approaches are provided that optimize spark characteristics in ignition systems. Existing systems can be easily retrofitted to provide enhanced spark characteristics such as improved spark energy, duration, or current without damaging or degrading other existing components in the system. At the same time, differences between operating characteristics of different coils or coil drivers are transparent to existing system controllers, drivers, or other components and, consequently, these elements can be safely operated with a wide variety of different ignition coils.

In many of these embodiments, a first current is supplied to a first primary winding of an ignition coil and a second current is supplied to a second primary winding of the ignition coil. In some examples, the second current may be supplied to the second primary coil after sensing the first current in the first primary winding.

A voltage is generated across the secondary winding of the ignition coil and an ignition spark current is generated at a spark plug coupled to the secondary winding. The ignition spark current is based and/or proportional to the generated voltage and the sum of the first current and the second current. The flow of the first and second currents creates energy that is stored in the magnetic field of the coil and this energy is eventually transformed and used to create a spark having enhanced spark characteristics.

The amount of the first current supplied to the first primary winding is controlled by a controller (e.g., an ECU) and the generated voltage is maximized by the first and second currents supplied to the respective first and second primary windings. In operation, at least one predetermined ignition spark characteristic is optimized without requiring a change in the first current amount.

A spark is generated by halting the flow of the first current and the second current. In this regard, the second current may be halted after the halting of the first current is sensed.

The first current may be sensed by various types of devices. For example, the first current may be sensed using a sensor such as a Hall effect sensor, a giant magnetoresistance (GMR) sensor, or one or more resistive elements. Other examples of sensing arrangements are possible. The first current may also be sensed by monitoring other circuit operating characteristics (e.g., the voltage behavior of the first primary winding).

As mentioned, the present approaches allow existing controllers and control arrangements to be interchangeably operated with different ignition coils in ignition systems. More specifically, an original coil having a single primary winding can be replaced with a replacement ignition coil having a first primary winding, a second primary winding, and a secondary winding. The replacement coil is coupled to the existing controller, coil driver, and spark plug of the ignition system. A controller is operated with the replacement coil within predefined operating limits so as to optimize one or more predetermined ignition spark characteristics of the spark plug. In one example, the predefined operating limits comprise predefined current limits.

In others of these approaches, a first current is supplied to a first primary winding of an ignition coil. Upon sensing the presence of the first current in the first primary winding of the ignition coil, a second current is supplied to a second primary winding of the ignition coil and a secondary current is generated in a secondary winding of the ignition coil. The secondary current causes the formation of a voltage across the secondary winding of the ignition coil. Upon expiration of a predetermined time period (e.g., the dwell time), the first current is halted to the first primary winding of the ignition coil. Upon sensing the halting of the first current to the first primary winding, the second current is removed from the second primary winding of the ignition coil increasing the voltage in the secondary winding and generating a spark at a spark plug coupled to the secondary winding. In some examples, the ignition coil is coupled to a controller and only the first current is sensed at the controller without sensing the second current.

Thus, approaches are provided that optimize spark characteristics in ignition systems. Existing systems can be easily retrofitted according to these approaches to provide enhanced spark characteristics such as improved or enhanced spark energy, duration, or current without damaging or degrading other existing components in the system. At the same time these enhanced characteristics are provided, existing controllers, drivers, and other components can be safely operated with a wide variety of different ignition coils. In this regard, the differences between the operating characteristics of various ignition coils are transparent and invisible to the existing controllers, drivers, or other system components.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. It will further be appreciated that certain actions and/or steps may be described or depicted in a particular order of occurrence while those skilled in the art will understand that such specificity with respect to sequence is not actually required. It will also be understood that the terms and expressions used herein have the ordinary meaning as is accorded to such terms and expressions with respect to their corresponding respective areas of inquiry and study except where specific meanings have otherwise been set forth herein.

DESCRIPTION

Figure 1:
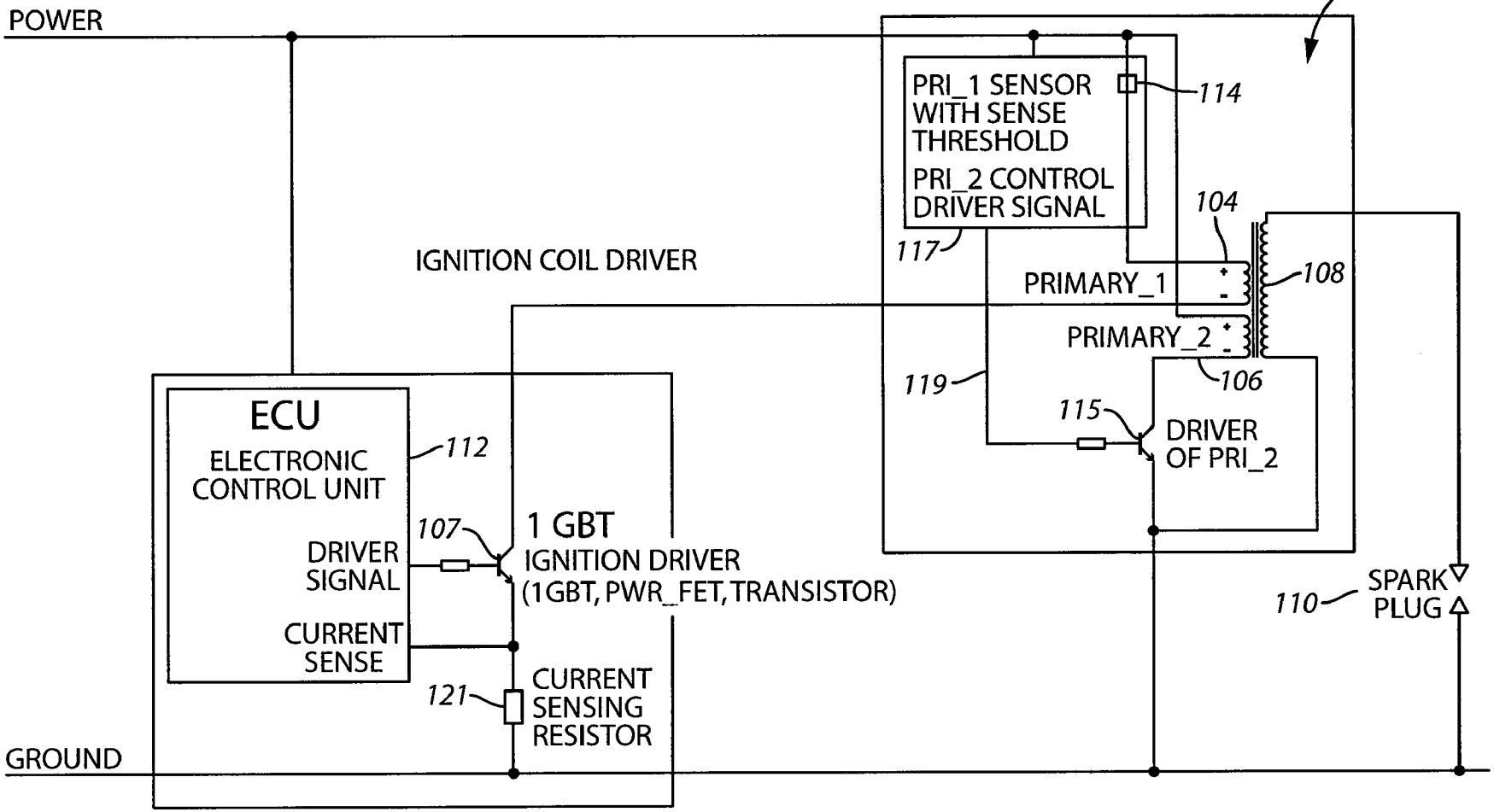
FIG. 1 comprises a circuit diagram of one example of a circuit for optimizing spark characteristics according to various embodiments the present invention.

Referring now to FIG. 1, one example of a circuit for optimizing spark characteristics in an ignition system is described. As described herein, various ignition spark characteristics may be optimized. For example, spark energy, spark duration, and spark current may be optimized. Other characteristics may also be optimized.

An ignition coil 102 includes a first primary winding 104, a second primary winding 106, and a secondary winding 108. The secondary winding 108 is connected to and drives a spark plug 110. Although only two primary windings are shown in the examples described herein, it will be appreciated that more than two primary windings may also be employed using the present approaches. In addition, although the use of only a single secondary winding is described in the following examples, it will be appreciated that any number of secondary windings can also be used.

As described in the examples herein, the ignition coil 102 includes the two primary windings 104 and 106 and through the use of these two windings has an inductance that is typically lower than coils that include only a single primary winding (thereby allowing more total current to flow and, consequently, more energy to be stored for release as a spark). The thicknesses (e.g., gauges) of the wires used for the first winding 104 and the secondary winding 106 (and resulting resistances of these two windings) are examples of two characteristics that determine the current ratio carried between the first winding 104 and the second winding 106 (and hence the total power that can be stored by the coil 102). As described elsewhere herein, adjusting these characteristics allows a particular coil to be configured and arranged to provide the desired spark characteristics (e.g., the spark power level).

The current flow in the first primary winding 104 is controlled by a driver 107 which in turn is controlled by an electronic control unit (ECU) 112. The ECU 112 may be any type of programmable electronic device such as a microprocessor or programmable logic array (PLA). Alternatively, the ECU 112 may be some combination of analog and/or digital circuitry. Other examples of ECUs may also be used. The driver 107 and the ECU 112 may be coextensive (e.g., formed as part of the same integrated circuit and/or disposed within the same housing) or separate elements. Additionally, a current sensing resistor 121 may be coupled to the ECU 112 to allow the ECU 112 to measure current.

A sensor 114 senses the amount of current in the first primary coil and determines when this current level reaches a predetermined level. The sensor 114 may be any type of sensor that measures current directly or, in other approaches, a sensor that measures a quantity representative of current (e.g., voltage or power). In addition, the sensor 114 may be any number of devices or components or any combination of devices or components that perform the above-mentioned functions. To give a few examples, the sensor 114 may be a Hall effect sensor, a giant magnetoresistance (GMR) sensor, or one or more resistive elements. Other examples of sensors can also be used.

When the current in the first primary winding 104 of the coil 102 (as measured by the sensor 114) reaches a predetermined level, a driver 115 is activated by driver controller 117. When activated, the driver 115 allows the flow of current from a power source 116 to the second primary winding 106 of the coil. In one example, the driver 115 is a transistor that is activated and deactivated by application of a control signal from the driver controller 117.

More specifically, the driver controller 117 receives information from the sensor 114 indicating the current level and when the current has reached a predetermined level, the driver controller 117 sends a control signal on a control line 119 to the driver 115 activating the driver and allowing current to flow in the secondary winding 106. Conversely, when the current is determined to be below a predetermined level, the driver controller 117 sends a different control signal on line 119 to deactivate the driver 115 thereby halting the current flow in the second winding 106 of the ignition coil 102. The driver controller 117 may be any combination of digital or analog electronics or drivers that accomplish these functions. In one example, the driver controller 117 is an AD 24-00 device manufactured by NVE Corporation. Additionally, the control signal on control line 119 can be any type of analog or digital signal.

In one example of the operation of the circuit of FIG. 1, a first current is supplied to a first primary winding 104 of the ignition coil 102 and a second current is supplied to a second primary winding 106 of the ignition coil 102. The ECU 112 activates the driver 107 to provide the first current. In some examples, the second current may be supplied to the second primary winding 106 after the sensor 114 determines that the first current is being supplied to the first primary winding 104. A voltage is generated across the secondary winding 108 of the ignition coil 102 and an ignition spark current is generated at a spark plug 110 coupled to the secondary winding 108. The ignition spark current is based upon and/or is proportional to the generated voltage and the sum of the first current and the second currents.

As mentioned, the amount of the first current supplied to the first primary winding 104 is controlled by the ECU 112. The voltage is maximized (by supplying the first current to the first primary winding 104 and the second current to the second primary winding 106) thereby optimizing one or more predetermined ignition spark characteristics. This action occurs without requiring a changing, increasing, or altering of the amount of the first current. More specifically, the first current never exceeds predetermined operating limits above which damage to the ECU 112 or other circuit elements may occur.

A spark is generated by halting the flow of the first current and the second current. In this regard, the second current may be halted after the halting of the first current is sensed (e.g., by the sensor 114).

So configured, the ECU 112 is only aware of the current in the first primary winding 104 of the ignition coil 102. The ECU 112 measures only this current (e.g., via the current sensing resistor 121) when determining whether currents are reaching potentially damaging or dangerous levels. In other words, additional current is supplied to the secondary winding 106 of the coil without triggering an over-current condition/reaction (or some other type of condition/reaction that is outside an established design characteristic) in the ECU 112. And, at the same time, improved spark characteristics are achieved due to the additional current provided to the secondary winding 106.

Moreover, the existing ECU 112 can be interchangeably operated with different ignition coils. More specifically, an original coil having a single primary winding can be replaced with a replacement ignition coil having two primary windings and a secondary winding. The new coil is constructed of suitable dimensions so as to easily and conveniently fit within the space provided for the existing coil.

The replacement coil is then coupled to the existing ECU 112 and to a spark plug 110, and the ECU 112 is operated within predefined operating limits so as to optimize one or more predetermined ignition spark characteristics of the spark plug. In one example, the predefined operating limits relate to predefined current limits. For instance, the ECU 112 may be limited as to an upper limit of current value after which it becomes damaged.

The coil 102 is configured and constructed to provide the desired spark characteristics. In this regard and to provide one example, the respective gauge sizes of the wires that constitute the first and second primary windings of the coil may be appropriately varied to provide the appropriate spark enhancement characteristics. For instance, if a 150 percent increase of power (and current) is desired for the coil 102, then the inductance of the coil 102 is required to be reduced to approximately ⅔ of the inductance of the original coil that it replaces. In this example, the first primary winding 104 is configured to carry approximately 100 percent of the original current and the (new) secondary winding 106 is configured to carry the additional approximately 50 percent. As a result, the winding resistance for the second primary winding 106 of the coil 102 is approximately twice the resistance of the first winding 104. To achieve this result and to take one example, the wire size of the second primary winding 106 is increased to be three gauges greater the gauge of the first primary winding 104. Any additional heat created by the additional second primary winding 106 is already partially mediated by the reduction in turns and can be further diminished by configuring the coil so that additional space exists about the coil to allow extra air to flow about the coil, which, in turn, dissipates any additional heat.

It will be appreciated that this is only one example of how a coil can be constructed and configured according to the present approaches. For example, other characteristics such as length of wire, composition of the wire may also be altered and adjusted depending upon the desired results.

So configured, a coil having first and second primary windings provides enhanced spark characteristics compared to the original coil that it replaces, fits into the same space as the original coil, but does not overload or otherwise adversely impact the operation the existing ECU (or other existing components). To take one example of some advantages provided by these approaches, if the ECU monitors current and adopts dwell time to the varying conditions, the ECU treats the new coil as if it were the original coil, acts in the same way as if it were operating with the original coil (e.g., in dwell time calculations), but additionally the system provides the desired enhanced spark characteristics (e.g., enhanced spark power).

Figure 2:
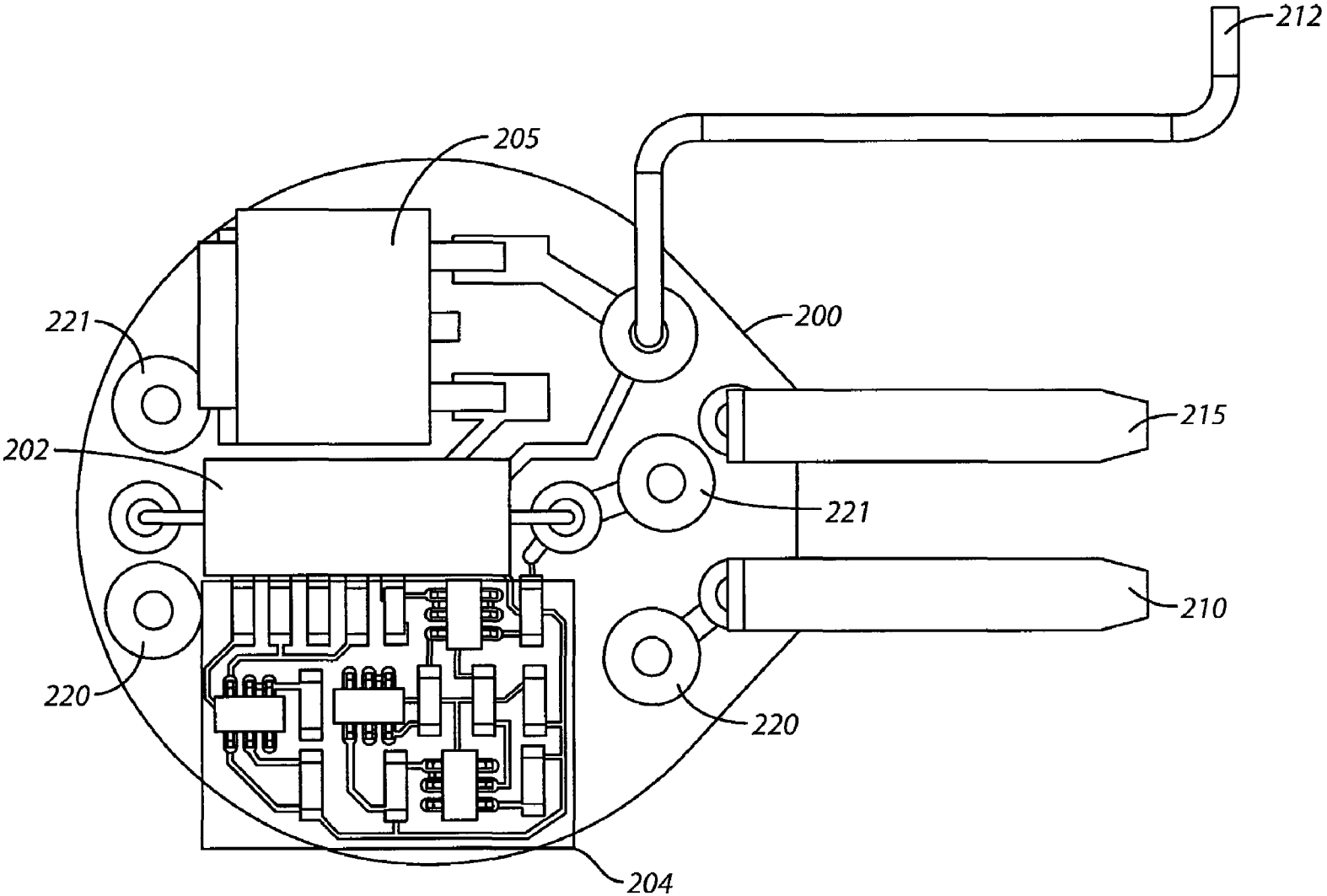
FIG. 2 comprises a perspective diagram of a device for optimizing spark characteristics in an ignition system according to various embodiments of the present invention.
Figure 3:
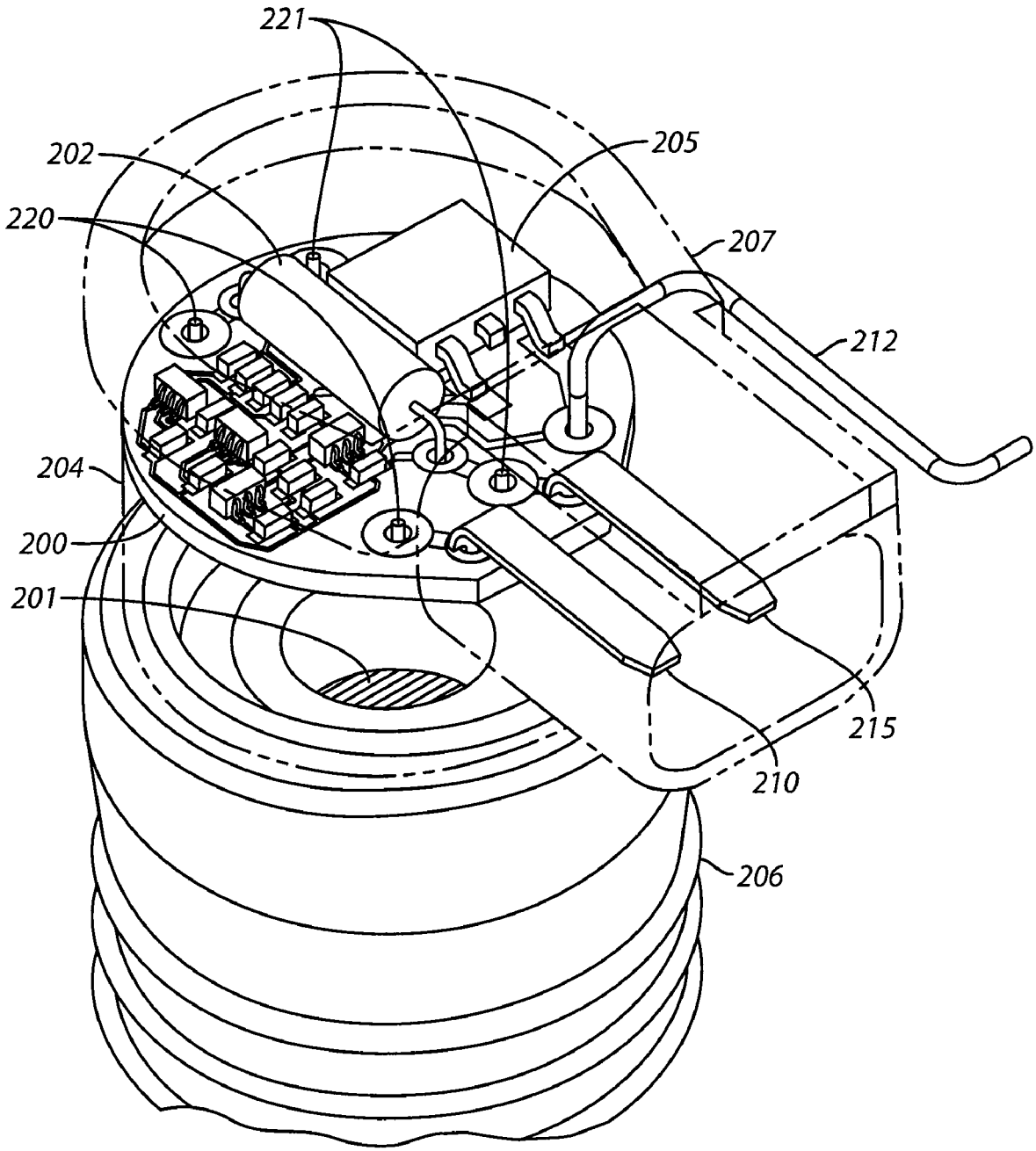
FIG. 3 comprises a perspective diagram of the device of FIG. 2 for optimizing spark characteristics and one example of positioning this device at least partially within an ignition coil according to various embodiments of the present invention.
Figure 4:
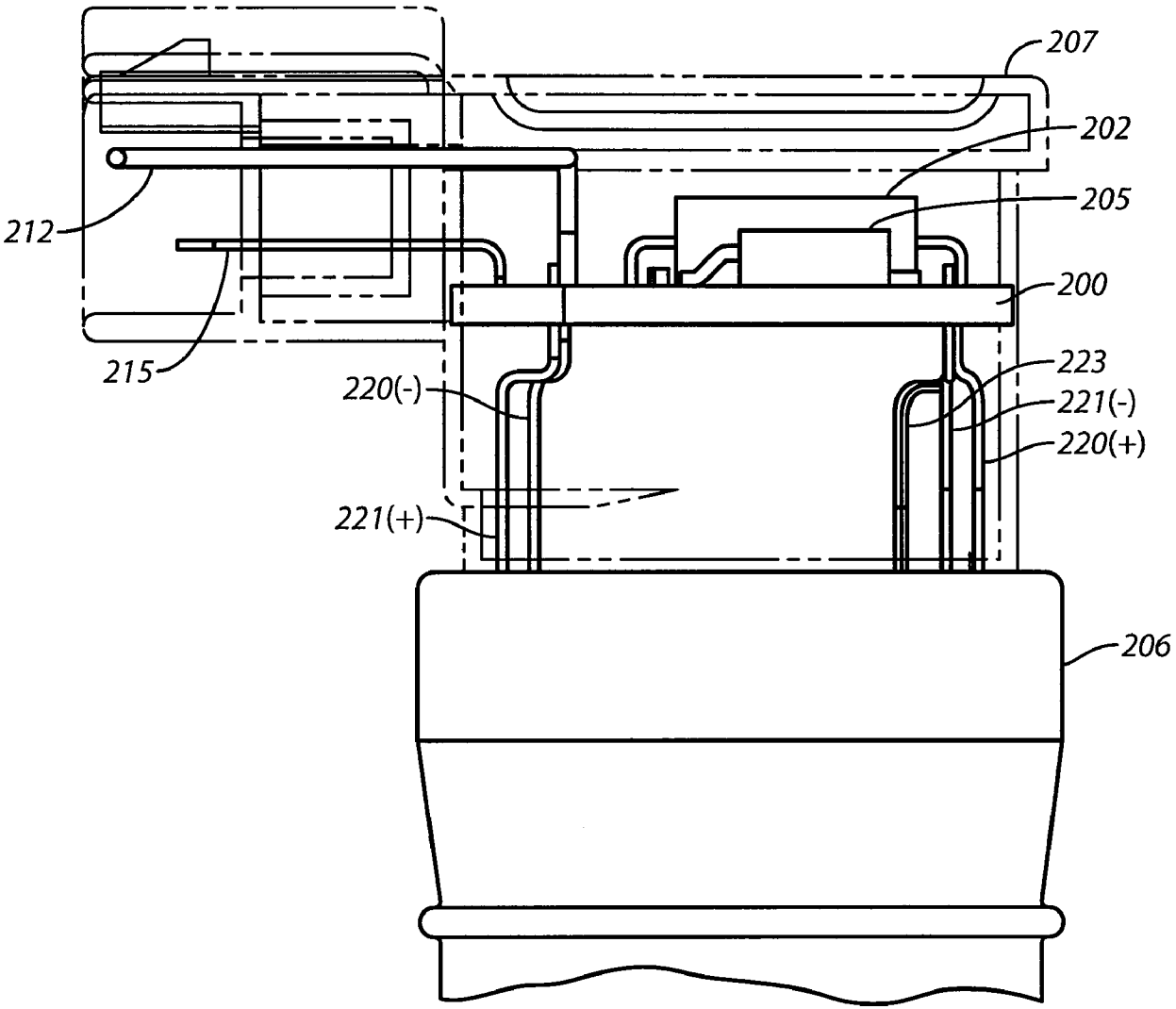
FIG. 4 comprises a side view of the devices of FIGS. 2 and 3 for optimizing spark characteristics and one example of positioning this device at least partially within an ignition coil according to various embodiments of the present invention.

Referring now to FIGS. 2-4, one example of the configuration and placement of devices that are used to enhance spark characteristics utilizing the present approaches is described. Referring now specifically to FIG. 2, a circuit board 200 is coupled to a sensor 202. In many of these examples, the circuit board 200 is a printed circuit board that is arranged to include various electronic components and to establish connections between these components and other components residing both inside and outside the circuit board 200. As mentioned, the sensor 202 may be a Hall effect sensor, a giant magnetoresistance (GMR) sensor, or one or more resistive elements (to give a few examples). In this example, the sensor 202 is a resistor.

A driver controller 204 (with sense electronics) receives signals from the sensor 202 and transmits signals to a driver 205 to control the driver 205. These signals activate and deactivate the driver 205 to control current flow in the secondary primary winding of the coil. In one example, the driver 205 is a transistor such as an Insulated Gate Bipolar Transistor (IGBT) or and ignition IGBT.

The circuit board 200 is disposed at the top end of a coil housing 206 that encloses the coil 201 and a spark plug (not shown). The circuit board 200 (and the components positioned thereon) is constructed to have such suitable dimensions so that it can fit comfortably and easily at least partially within the coil 201 and/or coil housing 206. A cover surrounds the circuit board 200. The cover includes appropriate openings to allow contact with external elements (e.g., the ECU, ground, and a power supply).

In one example, the circuit board 200 is shaped as an ellipse or ellipse-like shape having dimensions of approximately 0.90 inches and with a thickness of less than approximately 0.25 inches. In many examples, this shape matches or approximates the cross-sectional shape of the housing 206. However, it will be appreciated that other dimensions may be used and that these dimensions may be customized and changed to allow the circuit board 200 to be disposed and fit within particular ignition coils or housings having other shapes and/or dimensions.

The coil 201 includes first primary winding 220 and a second primary winding 221 as well as a secondary winding 223. Current sensor 202 senses the current in the first primary winding 220 via a contact/lead 208. An external ECU (not shown) controls the current supplied to the first primary winding of the coil via the lead 210. A ground wire 212 provides a ground connection for the various elements of the system. A power supply (e.g., a vehicle battery, not shown) supplies power and current to the second primary winding under control of the ECU via lead/contact 215.

As shown in FIGS. 3 and 4, the circuit board 200 can be conveniently placed or disposed at the top end of the coil housing 206. The circuit board 200 can be secured to the housing 206 using screws, glue, or any other suitable fastening arrangement. Other placements of the circuit board 200 are possible. As shown, the circuit board 200 (including the driver 205) is positioned in close proximity to ignition coil 201. In this example, these two elements are within 0.5 inches of each other. The elements are positioned closely so that no other circuit elements (other than connecting wires) are positioned there between.

The use of a circuit board 200 that fits within or around current system elements and structures facilitates the easy and convenient upgrading and retrofitting of existing ignition systems to provide enhanced spark characteristics. To take one example, a new coil can be added and the circuit board 200 attached to the new coil (as well as external circuit elements such as the ECU) in a minimal amount of time and without significantly disrupting the configuration, function, or operation of existing current elements and structures.

Figure 5:
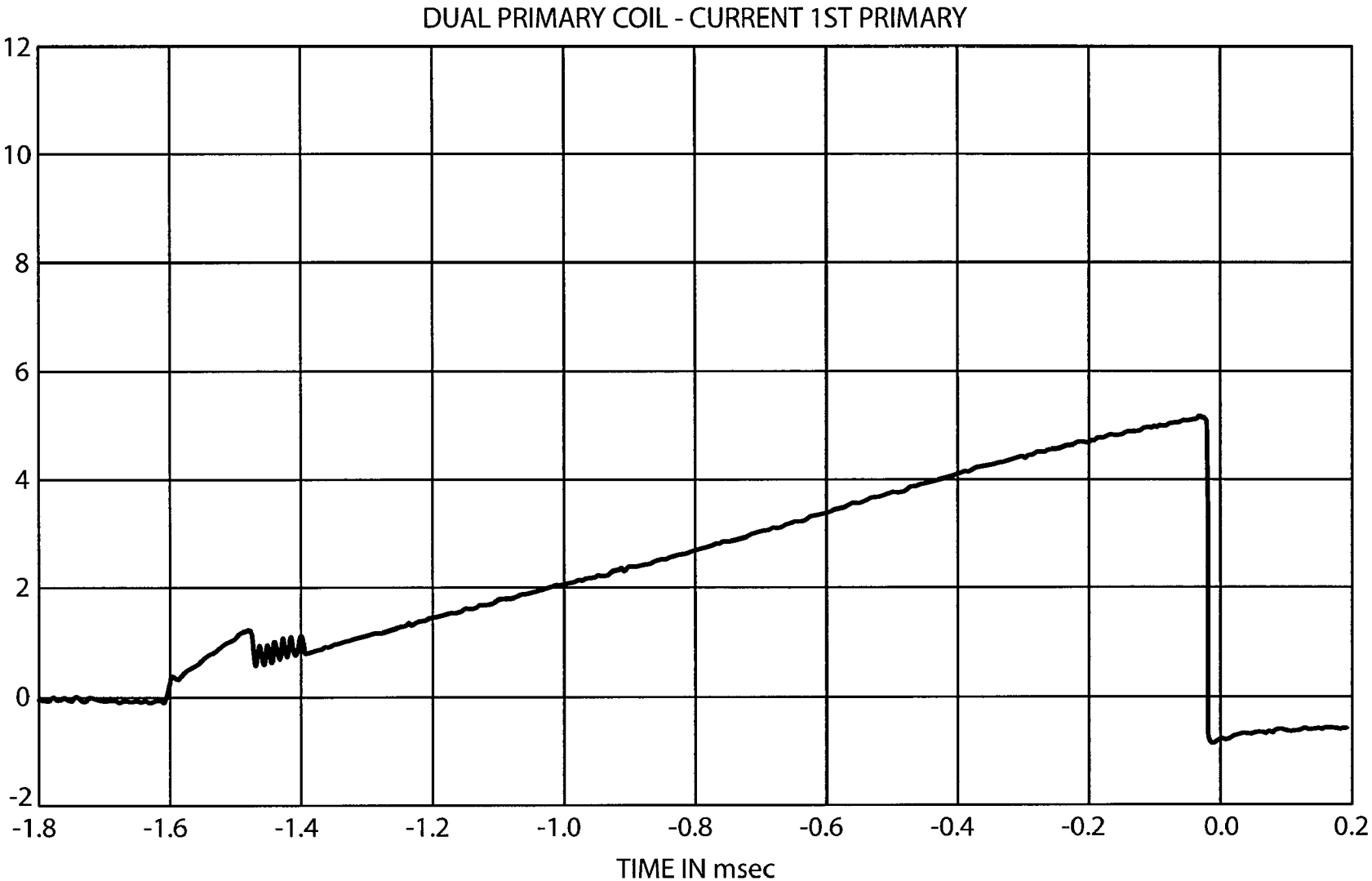
FIG. 5 comprises a graph of the current in a first primary winding of an ignition coil according to various embodiments of the present invention.
Figure 6:
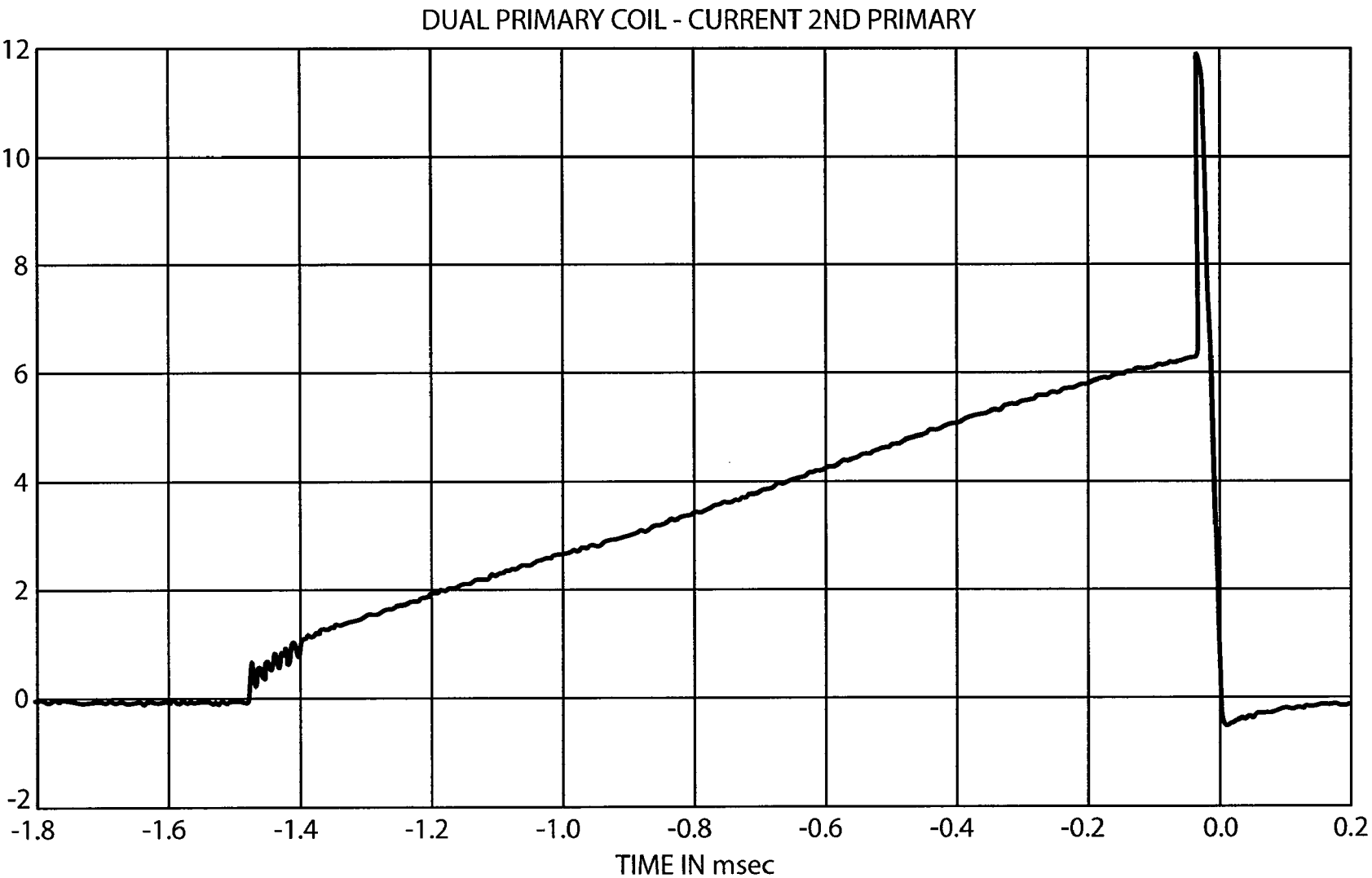
FIG. 6 comprises a graph of the current in a second primary winding of an ignition coil according to various embodiments of the present invention.
Figure 7:
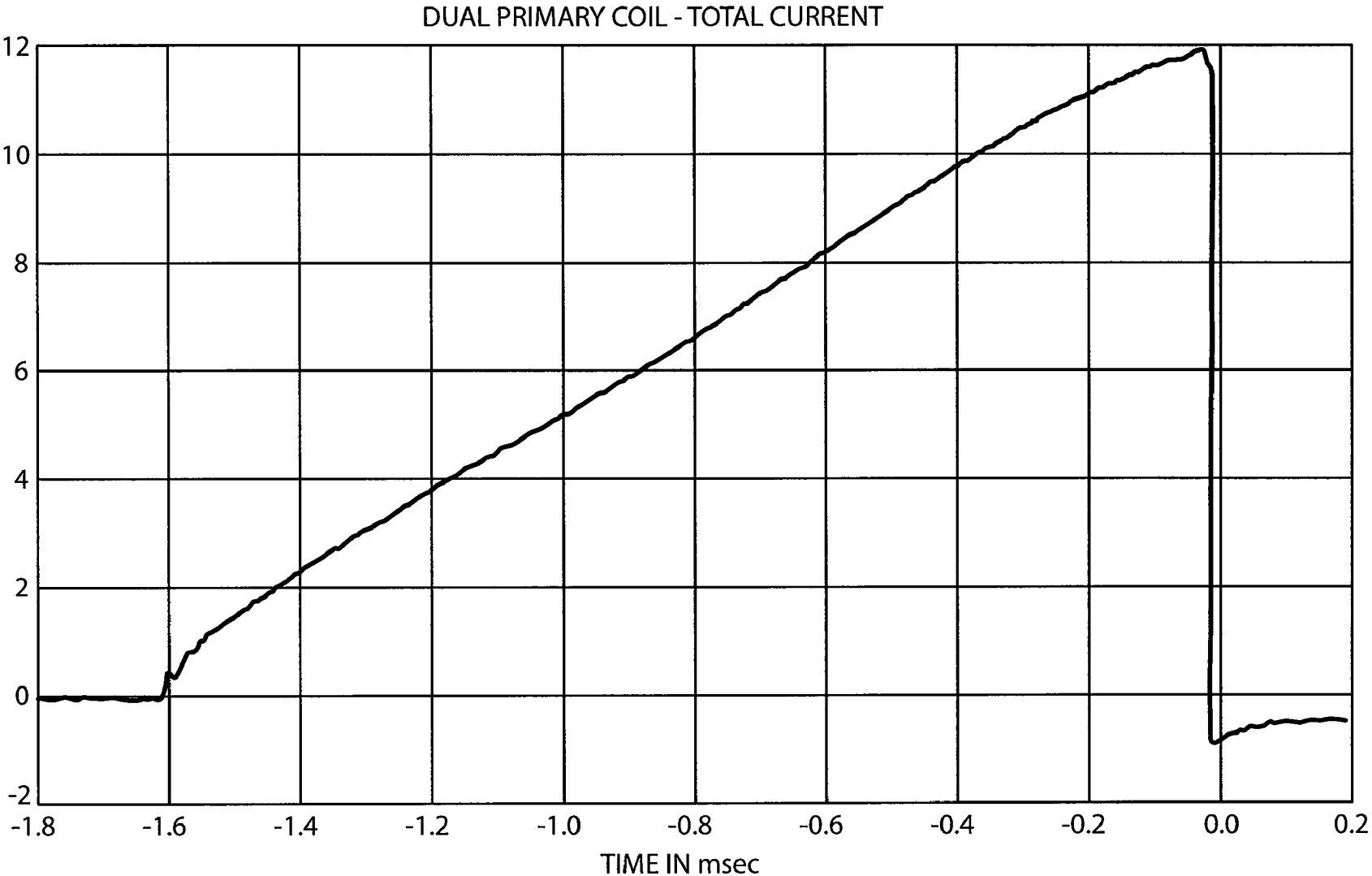
FIG. 7 comprises a graph of the total current in both the first primary winding and the second primary winding of an ignition coil according to various embodiments of the present invention.

Referring now to FIGS. 5-7, examples of graphs showing the current flow through an ignition coil using the present approaches are described. It will be appreciated that these are only examples of how current flow may occur and that other examples are possible. In this example, the ignition coil includes a first primary winding, a second primary winding, and a secondary winding and (as with the examples of FIGS. 1-4) the current flow in the first primary winding is controlled by an Electronic Control Unit (ECU) while the current flow in the second primary winding is controlled by a sensor/driver arrangement (as with the examples of FIGS. 1-3). However, as mentioned above, more than two primary windings may be used and more than one secondary winding may be used.

Referring now specifically to FIG. 5, one example of a graph showing the current flow in the first primary winding of the coil is described. The current flow begins at 0 amps at t=−1.8 ms. At t=−1.6 ms, the current begins to flow in the first primary winding and this value may be determined by the ECU. At approximately t=−1.5 ms, the current in the second primary winding of the ignition coil is turned on and this flow of current in the second primary winding causes a ripple in the current flow in the first primary winding of the coil as shown between approximately t=−1.5 and t=−1.4 ms in the graph of FIG. 5. As can be seen, the current continues to rise in the first primary winding of the coil until it reaches approximately 6 amps at or near time t=0. At approximately time t=0, the current in this first primary winding is turned off (followed by current in the second primary winding) thereby creating a spark at the spark plug.

Referring now to FIG. 6, one example of a graph showing the current flow in the second primary winding of the ignition coil is described. The current starts at 0 amps at t=−1.8 ms. The current continues to be 0 amps in the second primary winding until approximately t=−1.5 ms at which time current is applied to the secondary winding of the coil. The current continues to rise until approximately t=0 at which time the current in the first primary winding is first turned off. The sudden turning off of the current in the first primary winding operates to create a temporary current spike in the current flowing in the second primary winding. However, the halting of the current flow in the first primary winding is sensed and responsively, the current in the second primary winding is turned off, thereby reducing the current in the second primary winding to 0 amps shortly after t=0.

Referring now to FIG. 7, one example of a graph showing the total current flowing through both the first and second primary windings of the ignition coil is described. At time t=−1.8 ms, the total current is 0 amps. The total current rises gradually from t=−1.6 ms to t=0 when the currents to the first primary winding and then the second primary winding are turned off and reduced to 0 amps. As has been discussed elsewhere in this specification, this action has the effect of creating a spark in a spark plug that is coupled to the secondary winding of the ignition coil and this created spark has enhanced spark characteristics (e.g., improved energy characteristics).

As has also been described elsewhere in this specification, the ECU (or other control elements) is aware of and is affected by only the current in the first primary winding of the ignition coil. If the ECU (or other control element), for example, had a current limit of 8 amps (above which damage would occur to the ECU), as can be seen in FIG. 5, this limit would never be reached or sensed by the ECU. However, the total current through all windings (as can be seen in FIG. 7) rises above 8 amps and, specifically in this example, to approximately 12 amps. In other words, the ECU (or other control element) is not aware of or directly affected by the current in the second primary winding of the ignition coil (as shown in FIG. 6) but the higher total current value (and consequently the enhanced spark characteristics) is still provided. Consequently, existing ignition systems can be retrofitted with new coils/devices that provide improved spark characteristics without adversely affecting existing system elements (such as ECUs).

Figure 8:
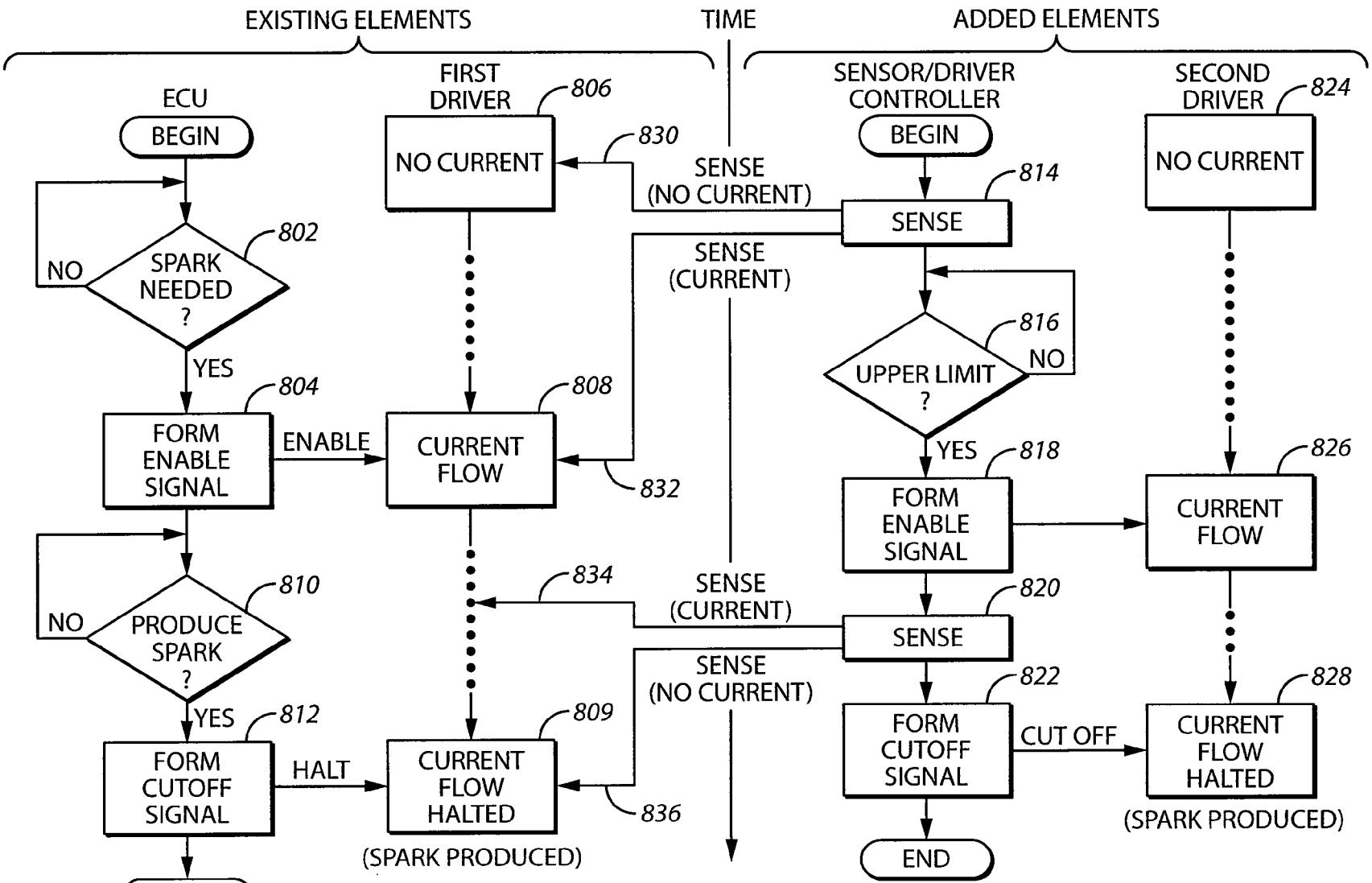
FIG. 8 comprises a flow chart showing the operation of an Electronic Control Unit (ECU), first driver, sensor/driver electronics, and second driver according to various embodiments of the present invention.

Referring now to FIG. 8, one example of the operation of an ignition system including an Electronic Control Unit (ECU), first driver, sensor/driver controller, and second driver (e.g. the system of FIG. 1) is described. At step 802, the ECU determines if a spark is needed to be eventually produced. In one example, this may be determined or based upon a calculated or predetermined dwell time. If the answer is negative, execution continues at step 802. If the answer is affirmative, the ECU forms a control signal to enable a first driver to supply current to the first primary winding of the ignition coil. At step 810, the ECU determines if it is time to actually produce a spark. If the answer is negative, execution continues at step 810. If the answer is affirmative, the ECU forms and sends a halt signal to the first driver in order to halt current flow to the first primary winding of the ignition coil.

The operation of the first driver in time relative to the ECU is now described. At step 806 no current is flowing through the first driver to the first winding. This condition exists until step 808 at which time the first driver is activated by the control signal received from the ECU. Current flow through the first primary winding is enabled until step 809 is reached at which time the halt signal is received from the ECU and the first driver is disabled thereby halting current flow through the first primary winding of the ignition coil.

Turning now to the operation of the sensor and second driver, at step 814, sensing occurs by the sensor. At step 830, the sensor senses no current is present in the first primary winding and no action is taken by the driver controller. The sensing occurs until step 832 is reached (corresponding to the first driver being enabled at step 808). Control continues at step 816, where it is determined whether an upper limit for current is reached. If the answer is negative, sensing continues with step 814 as described above. If the answer is affirmative, execution continues at step 818 where the driver controller forms an enable signal and transmits this enable signal to the second driver to thereby enable the second driver and, consequently, allow the flow of current through the second primary winding of the ignition coil.

At step 820, sensing by the driver controller continues. At step 834, for example, current is sensed in the first primary coil and no action is taken. However, at step 836 the sensing of the halting (or no current) is made. At step 822, due to the halting of the current flow in the first primary winding, the driver controller forms and sends a cut-off signal to the second driver, which halts the flow of current in the second primary winding. This occurs after the halting of the current in the first primary winding. As has been described elsewhere herein, the sudden halting of the current in both primary windings causes a spark to be generated at the spark plug.

The operation of the second driver in time with respect to the sensor/driver controller will now be described. At step 824, the second driver is disabled and no current flows in the second primary winding of the ignition coil. This continues until step 826 (corresponding to when the enable signal is received from the driver controller) when current flow is enabled and flows in the second primary winding. The current rises to some level and continues to flow until step 828 is reached (corresponding to when the cut-off signal is received from the driver controller) when the current flow in the second primary winding is halted (e.g., by receipt of the cut-off signal from the driver controller).

It will be appreciated that the existing or permanent system elements (e.g., the ECU and first driver) are not aware and their operation is not controlled or directly affected by the additional elements (e.g., sensor/driver controller and second driver) or the substitution of a replacement coil having different operating characteristics than the original coil. Consequently, the ECU (or other existing components) does not have to be re-programmed or otherwise modified and can be successfully and safely operated with the new elements (including the new coil). At the same time, elements such as the new coil (including the two primary windings), sensor, driver controller, and second driver enable enhanced spark characteristics and system performance to be achieved.

Those skilled in the art will recognize that a wide variety of modifications, alterations, and combinations can be made with respect to the above described embodiments without departing from the spirit and scope of the invention, and that such modifications, alterations, and combinations are to be viewed as being within the scope of the invention.

What is claimed is:

1. A method for optimizing at least one predetermined ignition spark characteristic for a vehicle ignition system having a controller therefore, the method comprising:

supplying a first current to a first primary winding of an ignition coil;

supplying a second current to a second primary winding of the ignition coil;

generating a voltage across a secondary winding of the ignition coil;

generating an ignition spark current at a spark plug coupled to the secondary winding that is based upon the generated voltage and the sum of the first current and the second current; and controlling an amount of the first current supplied to the first primary winding by the controller with the voltage being maximized by the first and second currents supplied to the respective first and second primary windings for optimizing at least one predetermined ignition spark characteristic without requiring a change in the first current amount.

2. The method of claim 1 wherein supplying the second current comprises supplying the second current after sensing the first current in the first primary winding.

3. The method of claim 2 wherein the first current is sensed using a sensor selected from a group consisting of: a Hall effect sensor, a giant magnetoresistance (GMR) sensor, and at least one resistive element.

4. The method of claim 2 wherein the first current is sensed by monitoring the voltage behavior of the first primary winding.

5. The method of claim 1 wherein generating a spark comprises halting the flow of the first current and the second current.

6. The method of claim 4 where the second current is halted after the halting of the first current is sensed.

7. The method of claim 1 wherein the at least one predetermined ignition spark characteristic is selected from a group consisting of spark energy, spark duration, and spark current.

8. A method of operating an ignition coil comprising:

supplying a first current to a first primary winding of an ignition coil;

upon sensing a presence of the first current in the first primary winding of the ignition coil, supplying a second current to a second primary winding of the ignition;

generating a secondary current in a secondary winding of the ignition coil, the secondary current causing the formation of a voltage across the secondary winding of the ignition coil;

upon expiration of a predetermined time period, halting the first current to the first primary winding of the ignition coil;

upon sensing the halting of the first current to the first primary winding, halting the second current to the second primary winding of the ignition coil increasing the voltage in the secondary winding; and generating a spark at a spark plug coupled to the secondary winding.

9. The method of claim 8 further comprising coupling the ignition coil to a controller and sensing only the first current at the controller without sensing the second current.

10. The method of claim 8 further comprising replacing an original ignition coil with the ignition coil, wherein the original ignition coil includes a single primary winding.

11. The method of claim 8 wherein the predetermined time period corresponds to a desired dwell time of the ignition coil.

12. An ignition module comprising:

an ignition coil including a first primary winding, a second primary winding, and a secondary winding;

a first driver circuit coupled to the first primary winding for selectively controlling a first current supplied to the first primary winding;

a second driver circuit coupled to the second primary winding, the second driver circuit being connected in a parallel electrical relationship to the first driver circuit for selectively controlling a second current to the second primary winding, the second driver circuit being configured and arranged to sense the first current flowing in the first primary winding, and to responsively supply a second current to the second primary winding upon sensing the first current; and wherein the first current and the second current act to create a secondary current in the secondary winding, the secondary current being proportional to a sum of the first current and the second current.

13. The ignition module of claim 12 wherein the secondary winding is connected to a spark plug, and wherein the second driver circuit is further configured and arranged to sense the halting of the flow of current in the first primary winding and to responsively halt the second current in the second primary winding, the halting of the first current and the second current acting to substantially increase the secondary current across the secondary winding and generate a spark at the spark plug.

14. The ignition module of claim 12 wherein the second driver circuit are disposed at least partially within the ignition coil.

15. The ignition module of claim 12 wherein the first driver circuit of the ignition coil is coextensive with the controller, and the controller only senses the first current in the first primary winding.

16. The ignition module of claim 12 wherein the second driver circuit is coupled to and positioned in close proximity to the ignition coil.

17. The ignition module of claim 12 wherein the second driver circuit comprises at least one transistor.

18. The ignition module of claim 12 wherein the second driver circuit comprises a sensor element selected from a group consisting of: a Hall effect sensor, a giant magnetoresistance (GMR) sensor, and at least one resistive element.

* * * * *